US005860763A

United States Patent [19]

Asplin

[11] Patent Number: 5,860,763

[45] Date of Patent: Jan. 19, 1999

[54] SIDEWALK LEVELING METHOD AND DEVICE

[76] Inventor: Charles Lee Asplin, 909 25th Ave. N., Fargo, N. Dak. 58102

[21] Appl. No.: 638,341

[22] Filed: Apr. 26, 1996

[51] Int. Cl.[6] ..... B66F 11/00

[52] U.S. Cl. ..... 404/78; 254/93 R; 254/134

[58] Field of Search ..... 404/78, 73, 99, 404/83; 254/133 R, 93 R, 134; 248/354.4, 354.5, 354.7; 104/2, 11

[56] References Cited

U.S. PATENT DOCUMENTS

| | | | |
|---|---|---|---|
| 4,096,675 | 6/1978 | Howard et al. | 52/79.1 |
| 4,194,726 | 3/1980 | Hance | 254/133 |
| 4,850,752 | 7/1989 | Carey-Yard | 104/2 |
| 4,962,913 | 10/1990 | Stewart | 254/269 |
| 4,982,930 | 1/1991 | Stewart | 404/99 |
| 5,379,987 | 1/1995 | Cleary | 254/134 |
| 5,419,653 | 5/1995 | Hollon et al. | 404/17 |
| 5,489,165 | 2/1996 | Smith | 405/284 |
| 5,577,446 | 11/1996 | Perry et al. | 104/2 |

*Primary Examiner*—James Lisehora
*Attorney, Agent, or Firm*—Curtis V. Harr

[57] ABSTRACT

The present application discloses a sidewalk lifting device made of steel framed tower that has a flat plate extending inward from the lowest end of the tower. This plate holds the lower surface of a sidewalk slab and also provides the lifting surface to elevate a damaged sidewalk. Additionally, attached to the inside surface of the tower in a position above the plate, is an adjustable slab brace frame which serves to hold the upper surface of a given sidewalk slab while it is being lifted.

The lifting tower also has on its upper end outward extending frame members. When lifting a damaged sidewalk, multiple lifting devices may be used and supplied with hydraulic bottle jacks which fit on the outside edge of the lifting towers.

A method of leveling sidewalks is also disclosed this method includes lifting a sidewalk slab to be leveled then injecting mason's sand into the cavity created between the lower surface of the sidewalk and the settled earth below it. This procedure is accomplished by the use of a sand blaster and a connected wand which is fed beneath the sidewalk and into the cavity. Once the cavity is completely filled with sand, the user simply removes the present invention completely. The use of sand in filling voids provides a very stable foundation for the sidewalk that will resist settling and prolong the useful life of the sidewalk.

4 Claims, 5 Drawing Sheets

SIDEWALK LEVELING METHOD AND DEVICE

BACKGROUND OF THE INVENTION

The present invention relates to a method of leveling an existing sidewalk which has had portions settle into the ground so as to become uneven over time. More specifically, a method of carefully raising a section of sunken sidewalk so as not to damage the section and allow for the injection of pressurized mason's sand into the cavity created between the bottom of the sidewalk slab and the settled ground.

Regardless of the skill and care used in the initial construction, sidewalks tend to become misaligned over time due to different rates of settlement of the earth. Uplift from freeze/thaw cycles, or tree root lifting are also common causes of sidewalk misalignment. These problems cause cracks in the sidewalk to develop and can also cause step-like structures to occur between sections of the sidewalk. The end result of this condition is the creation of hazards to sidewalk users and liability for those who are responsible for their care. Additionally, the uneven sidewalks are extremely difficult to effectively clear of snow and ice during the winter months in the northern areas of the United States, thus creating further hazards and liabilities for their users and owners.

In the past, there was a number of ways this problem was solved. One of these was to completely remove the damaged section of sidewalk and then re-pour it. The problem with this method is that although it works very well, it is time consuming and very expensive. The re-pour method also results in a checkerboard looking sidewalk as new portion are often a very different color from the older weathered sections. Another method that has been used with the step formation problem is to construct concrete or tar ramps from the lower portion of the sidewalk to the upper. The problem with this method is that it still leaves uneven sidewalk surfaces that are hazardous and difficult to maintain.

Finally, another method that is often used is mud jacking. In this repair method a hole is drilled through the uneven slab and wet mud is pumped under the slab until the slab becomes level. The first problem with this method it that it requires the drilling and patching of unsightly holes in each individual slab of cement. Second, as the mud is pumped under the slab, this method will not repair sections that have raised rather then settled. Finally, the use of wet mud often makes it difficult to effectively level a slab as the mud will settle over time while drying.

More recently, a number of patents have issued that attempt to deal with this problem in an effective and cost efficient manner. In U.S. Pat. No. 4,962,913, Stewart, Oct. 16, 1990, a method of lifting and repairing such damaged sidewalks is provided. The problem with this device is that by nature of its construction, a heavy frame supported by four wheels, it is large and cumbersome in operation. Further, this device requires the even lifting of a given slab in only in small sections at a time, as one portion of the device rests on an unlifted portion of sidewalk. In U.S. Pat. No. 4,982,930, Stewart, Jan. 8, 1991, the same inventor attempted to resolve the short comings of his prior art by lightening the frame and removing the wheels. However, the resulting apparatus is still large and cumbersome in its operation. Also as can be seen both of these lifting methods by Stewart block the walkway while the repair is in progress.

Therefore, from the foregoing discussion it can be clearly seen that it would be highly desirable to provide a means of leveling existing sidewalks in an inexpensive manner that is compact and easily used. The present invention addresses the foregoing problems by providing a pair of small, lightweight towers that attach to and lift either side of a damaged sidewalk so that mason's sand may be injected into the created cavity beneath it. Furthermore, the present invention also offers other advantages over the prior art and solves problems associated therewith.

SUMMARY OF THE INVENTION

It is the primary objective of the present invention to provide a method of repairing sidewalks that are damaged due to settling or changes in the elevation of the earth upon which they are built.

It is the further objective of the present invention to provide such a method that is economical and efficient in operation and that is light weight and compact.

These objectives are accomplished through the employment of small steel framed towers that have on their respective inside surfaces a flat plate extending inward from the lowest end of the tower. This plate may be formed by attaching an angled portion of iron to the tower frame. This plate holds the lower surface of a sidewalk slab to be raised and also provides the lifting surface to elevate a damaged sidewalk. Additionally, attached to the inside surface of each tower in a position above the plate, is an adjustable slab brace frames which serve to hold the upper surface of the damaged sidewalk while it is being lifted, thus preventing the slab from sliding away from the lifting device.

The lifting towers further have on their upper end, outward extending frame members. When lifting a damaged sidewalk, individual hydraulic bottle jacks are employed which fit on the outside edge of each of the lifting devices. The lifting pads of these jacks fit on the underside of the outward extending frame members of the lifting devices. The bottle jacks are usually placed on a block which is positioned in a hole excavated directly adjacent to the sidewalk at a point where lifting is desired. When upward force is applied by the operation of the jacks on to these frame members, the entire assembly is forced upward thereby lifting the damaged sidewalk.

After the sidewalk has been lifted and is in a level position relative to the undamaged sections, the user then injects mason's sand into the cavity created between the lower surface of the sidewalk and the settled earth below it. This procedure is accomplished by the use of a sand blaster and a connected wand which is fed beneath the sidewalk and into the cavity. By using a sand blaster one may easily and quickly pump sand into the cavity. Further the use of compressed air to move and place the sand results in the ability to fill a void with sand that is tightly packed and thus more likely to avoid settling. Once the cavity is completely filled with the sand, the user simply removes the present invention completely and fills in the excavated holes around the sidewalk and the job is finished.

The use of mason's sand provides a very stable foundation for the sidewalk that will resist settling and thus lengthen the useful life of the sidewalk. Further a well graded throughly dry granular material such as mason's sand may be used as with this type of sand noticeable settling will not occur.

Certain situations may arise where a given slab may have to be raised at one end and dropped at another. In this situation the slab is lifted as normal and dirt or tree roots may be removed from the raised section. The slab is then placed in a level position and sand is blasted under the slab to fill any voids.

For a better understanding of the present invention reference should be made to the drawings in which there is illustrated and described preferred embodiments of the present invention.

DESCRIPTION OF THE PREFERRED EMBODIMENT

Figure 1:
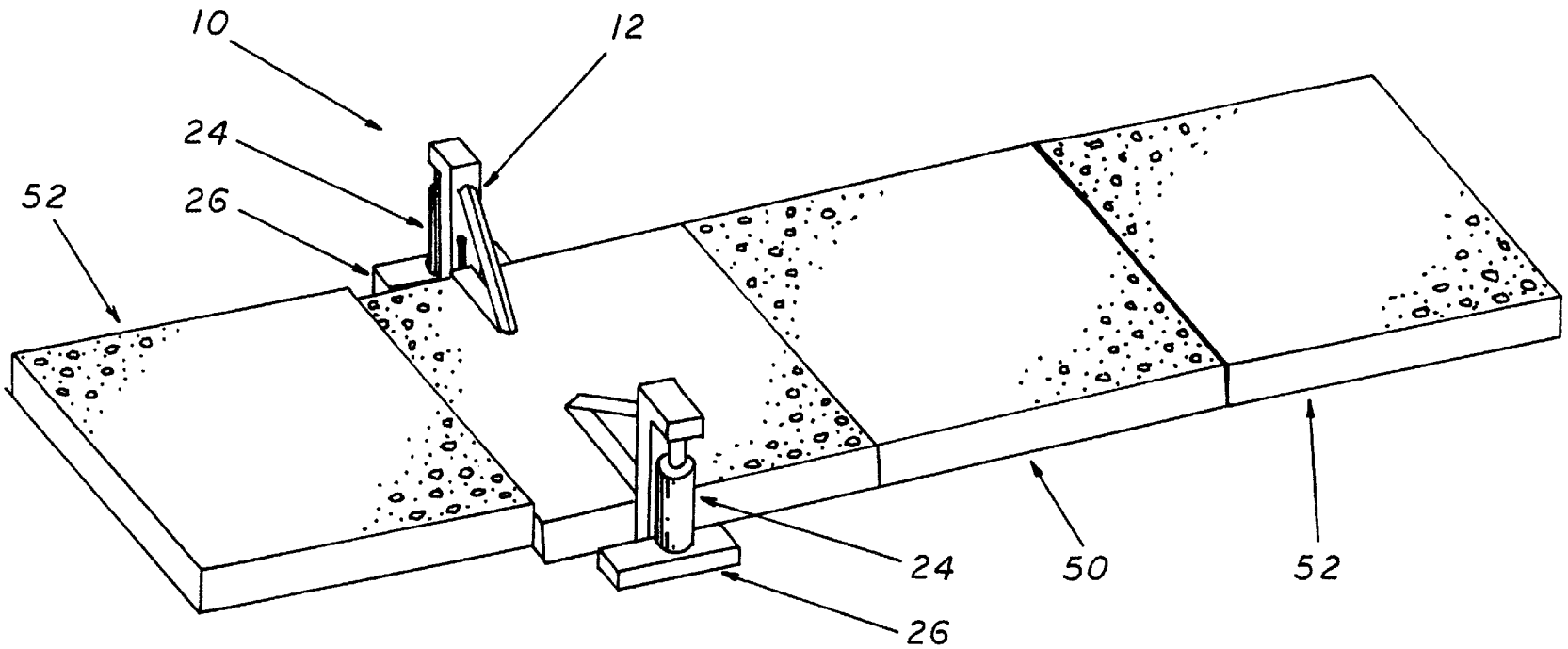
FIG. 1 is a perspective view of a damaged sidewalk with a sunken portion showing the manner in which the present Sidewalk Leveler attaches to a sidewalk slab.

Referring now to the drawings, and more specifically to FIG. 1, the Sidewalk Leveler setup 10 comprises one or more identical lifting towers or sidewalk lifters 12 which are placed facing one another or in an efficient arrangement on either side of a damaged sidewalk slab 50 and as close to a level sidewalk slab 52 as possible. Each of the lifting towers 12 uses a hydraulic bottle jack 24 which provides the lifting force for the present invention. The hydraulic bottle jacks 24 rest upon bottle jack blocks 26 which rest adjacent to the damaged sidewalk slab 50.

Figure 2:
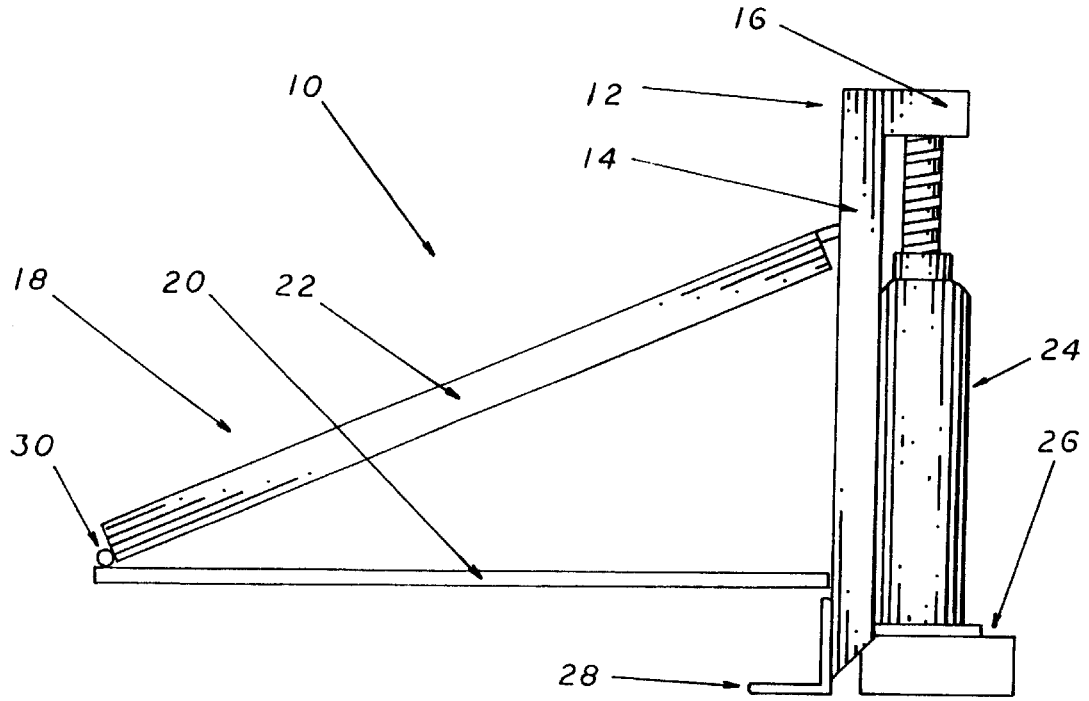
FIG. 2 is a side elevation view of the present invention showing the orientation of its major components and the manner in which a standard bottle jack fits within the frame of Sidewalk Leveler.

FIG. 2 shows the construction of the Sidewalk Leveler 10. The lifting towers 12 comprise a vertical frame 14 to which an outwardly extending horizontal frame 16 is attached at its most upward end and an inwardly extending lower slab brace frame 28 is attached at its lowermost end. The hydraulic bottle jack 24 and the bottle jack block 26 fit along the outside edge of the vertical frame 14. The upper end of the hydraulic bottle jack 24 extends upward to and engages the lower surface of the horizontal frame 16 of the lifting tower 12. In this manner, when force is applied to the hydraulic bottle jack 24, the entire Sidewalk Leveler 10 is forced in an upward manner, thereby lifting a given sidewalk slab.

Directly above the lower slab brace frames 28, and on the inside surface of the lifting tower 12, are located the upper slab brace frame 18. The upper slab brace frame 18 is made up of a horizontal brace member 20, a diagonal brace frame 22 and a upper slab brace frame pivot 30 which is located at its most inward point. The purpose of the lower slab brace frame 28 is to provide a lifting surface for the damaged sidewalk slab 50 and the purpose of the upper slab brace frame 18 is to hold said slab in a secure manner within the present invention during the lifting and filling operation.

Figure 3:
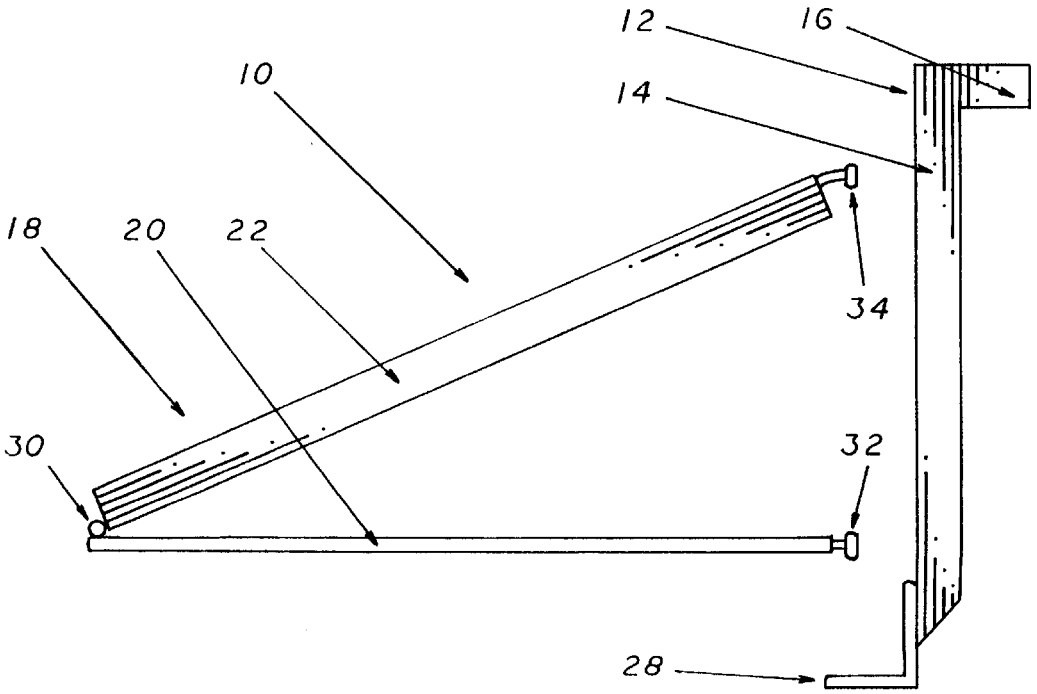
FIG. 3 is a side elevation view of the present invention showing the manner in which the upper slab brace attaches to the frame of the present invention.
Figure 4:
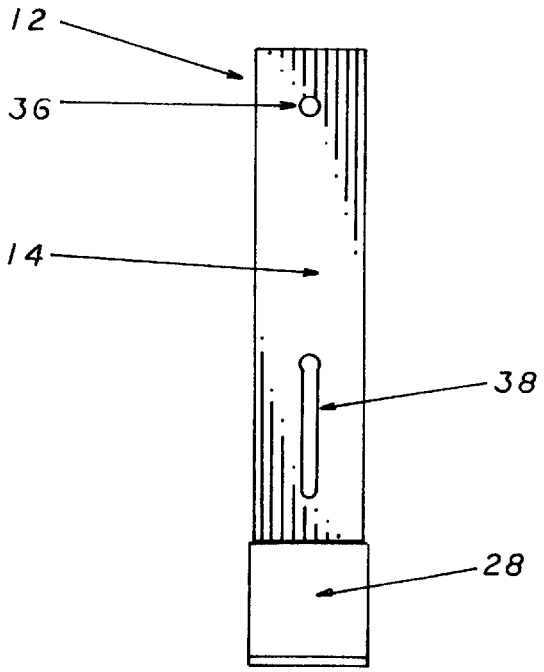
FIG. 4 is a front elevation view of the vertical frame of the present invention showing the location of the hole and slot used in the attachment of the upper slab brace frame to said vertical frame.

FIGS. 3 and 4 show the manner in which the upper slab brace frames 18 are connected to the lifting towers 12. On the outward most end of the horizontal brace members 20 is located a horizontal brace member lock pin 32 and on the outward most end of the diagonal brace member 22 is located the diagonal brace member lock pin 34. The inner surface of the vertical frame 14 contains the horizontal brace member lock hole 36 and the diagonal brace member lock slot 38. The locking pins, 32 and 34, each fit respectively into the locking holes and slots, 36 and 38.

Figure 5:
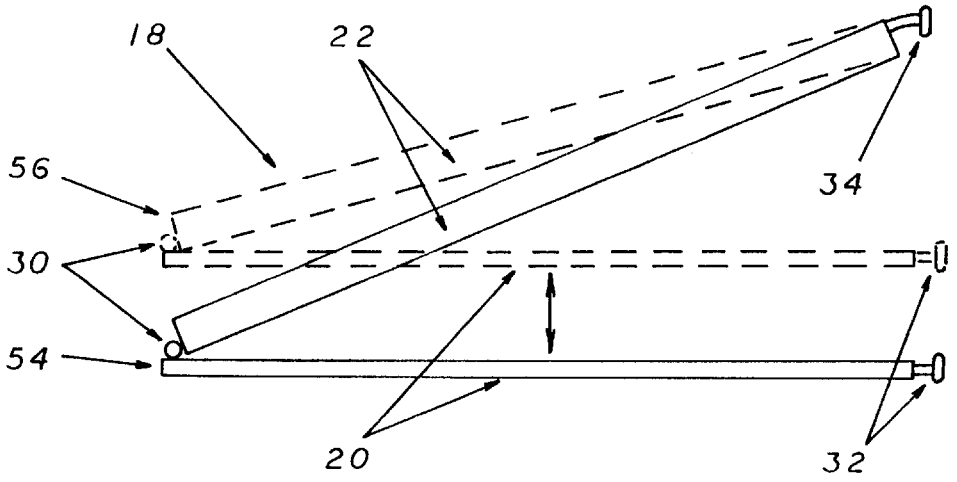
FIG. 5 is a side elevation of the upper slab brace frame showing the manner in which it can be adjusted up or down to accommodate varying thicknesses of sidewalk.

FIG. 5 shows the manner in which the upper slab brace frame 18 may be adjusted to accommodate varying slab thicknesses of sidewalk slabs. The lower horizontal brace member 20 slides within the diagonal brace member lock slot 38 thereby allowing the entire upper slab brace frame 18 to rotationally pivot around the upper slab brace frame pivot 30. This construction method allows the upper slab brace frame to be positioned in either a lower position 54, an upper position 56 or in any position in between as required by a given slabs thickness.

Figure 6:
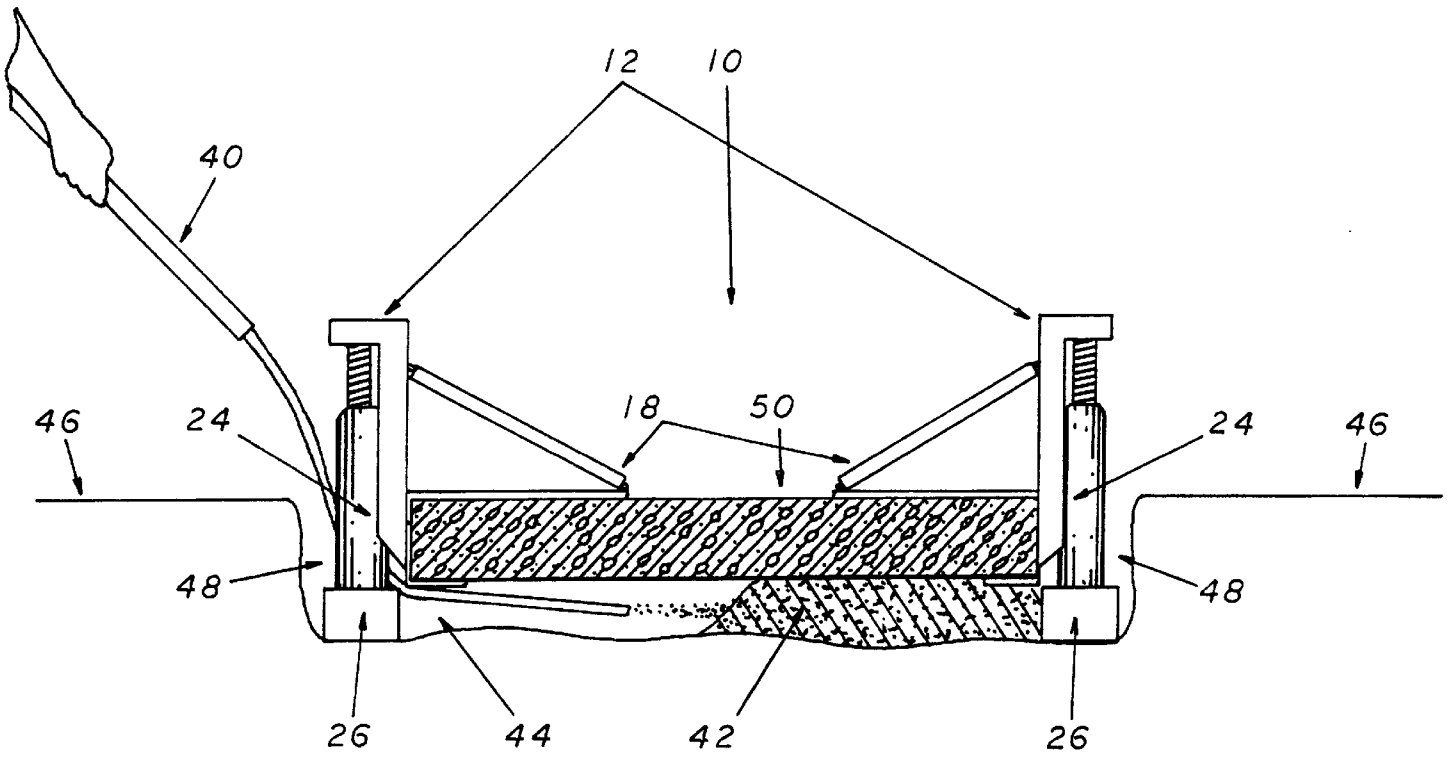
FIG. 6 is a side elevation cut-away view of the present invention showing how it is employed to lift a section of sidewalk and how sand is injected into the cavity created by lifting the sidewalk to restore a level and uniform walking surface.
Figure 7:
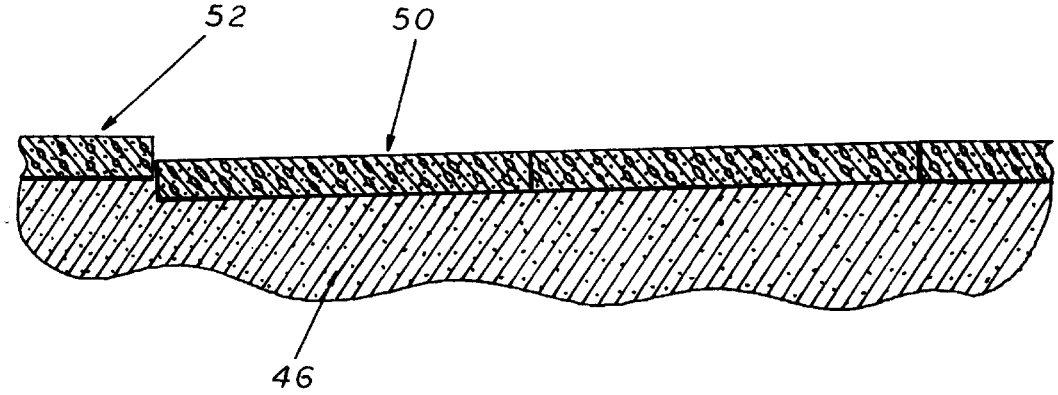
FIG. 7 is a side elevation cross-sectional view of sidewalk that has been damaged due to the settling of the supporting ground.
Figure 8:
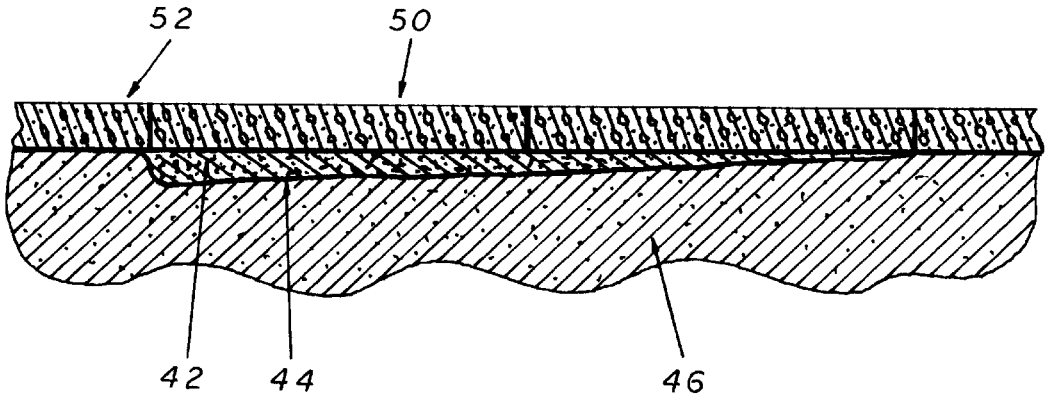
FIG. 8 is a side elevation cross-sectional view of a sidewalk that has been repaired by the use of the present invention.

FIG. 6 shows the Sidewalk Leveling setup 10 engaged to a damaged sidewalk slab 50 and in the raised position. The hydraulic bottle jacks 24 resting upon the hydraulic bottle jack blocks 26 located within the excavated hole 48, are extended upward, thereby raising the lifting towers 12 and the damaged sidewalk slab 50. The raising of the slab then creates a fill area 44 between the damaged sidewalk slab 50 and the ground 46 into which the user injects mason's sand 42 by use of a sandblaster wand 40. The mason's sand 42 creates a stable foundation free of air voids that will resist settling and thus prolong the useful life of the damaged sidewalk slab 50. FIGS. 7 and 8 show a damaged sidewalk slab 50 prior to leveling and its relative position to the level sidewalk slab 52 and the same section of sidewalk after the leveling process has been completed. Again, showing the orientation of the fill area 44, the mason's sand 42, and the ground 46 to the damaged sidewalk slab 50.

Although the present invention has been described in considerable detail with reference to certain preferred versions thereof, other versions are possible. Therefore, the spirit and scope of the appended claims should not be limited to the description of the preferred versions contained herein.

What is claimed is:

1. A method of lifting and leveling sidewalk slabs which comprises:

attaching one or more lifting device(s) to a slab to be adjusted wherein said lifting devices further comprise a vertical frame member having a top and bottom portion, a slab brace extending outward from said bottom portion, a horizontal frame portion adapted to receive the upper portion of said hydraulic jack said frame portion extending outward from the top portion of said vertical frame member, in a direction opposite of said slab brace, an upper brace frame for engaging the upper portion of said slab, a means of adjusting said upper brace frame to grasp slabs of different depths and a bottle type jack;

lifting said slab with said lifting device;

adjusting said slab to a level and desired final position;

filling the area under said level slab with sand placed using pressurized air; and removing said lifting devices.

2. The method of lifting and leveling sidewalk slabs as in claim 1 further comprising the step of:

digging a hole to allow for the attachment of said lifting device.

3. The method of lifting and leveling sidewalk slabs as in claim 2 further comprising the step of:

removing any excess dirt or fill from under said slab prior to leveling.

4. The method of lifting and leveling sidewalks as in claim 3 wherein the sand is a well graded mason's sand.

* * * * *